US010239181B2

(12) United States Patent
Xue et al.

(10) Patent No.: US 10,239,181 B2
(45) Date of Patent: Mar. 26, 2019

(54) DOUBLE-STATION WHEEL BURR REMOVING DEVICE

(71) Applicant: CITIC Dicastal CO., LTD., Qinhuangdao, Hebei (CN)

(72) Inventors: Bowen Xue, Qinhuangdao (CN); Yong Li, Qinhuangdao (CN); Jiandong Guo, Qinhuangdao (CN); Yongwang Zhao, Qinhuangdao (CN)

(73) Assignee: CITIC DICASTAL CO., LTD., Qinhuangdao, Hebei (CN)

( * ) Notice: Subject to any disclaimer, the term of this patent is extended or adjusted under 35 U.S.C. 154(b) by 3 days.

(21) Appl. No.: 15/609,456

(22) Filed: May 31, 2017

(65) Prior Publication Data

US 2018/0264616 A1 Sep. 20, 2018

(30) Foreign Application Priority Data

Mar. 20, 2017 (CN) ..... 2017 1 0167295

(51) Int. Cl.

| | |
|---|---|
| ***B24B 9/04*** | (2006.01) |
| ***B24B 29/04*** | (2006.01) |
| ***B24B 5/44*** | (2006.01) |
| ***B24B 41/06*** | (2012.01) |
| ***B24B 27/00*** | (2006.01) |
| ***B24B 29/00*** | (2006.01) |
| ***B24B 41/00*** | (2006.01) |
| ***B24B 19/00*** | (2006.01) |

(52) U.S. Cl.

CPC ..... *B24B 27/0023* (2013.01); *B24B 5/44* (2013.01); *B24B 9/04* (2013.01); *B24B 19/00* (2013.01); *B24B 27/0076* (2013.01); *B24B 29/005* (2013.01); *B24B 29/04* (2013.01); *B24B 41/005* (2013.01); *B24B 41/06* (2013.01)

(58) Field of Classification Search

CPC .... B24B 5/12; B24B 5/44; B24B 9/04; B24B 19/00; B24B 27/0076; B24B 29/005; B24B 29/04; B24B 41/00; B24B 41/005; B24B 41/02; B24B 41/06

USPC ..... 451/178, 190

See application file for complete search history.

(56) References Cited

U.S. PATENT DOCUMENTS

| | | | | | |
|---|---|---|---|---|---|
| 3,258,804 | A * | 7/1966 | Fowle | B24B 5/225 | 15/104.011 |
| 4,216,560 | A * | 8/1980 | Schmidt | B24B 41/06 | 15/268 |
| 2013/0102233 | A1* | 4/2013 | Cheon | B24B 27/033 | 451/331 |

FOREIGN PATENT DOCUMENTS

| | | | |
|---|---|---|---|
| CN | 203438027 | * | 2/2014 |
| CN | 204639842 | U | 9/2015 |
| CN | 105382654 | A | 3/2016 |
| CN | 205437373 | U | 8/2016 |
| CN | 205734250 | U | 11/2016 |
| CN | 206544079 | U | 10/2017 |
| DE | 20020624 | U1 | 3/2001 |

(Continued)

*Primary Examiner* — Eileen Morgan

(74) *Attorney, Agent, or Firm* — Cooper Legal Group, LLC

(57) ABSTRACT

A double-station wheel burr removing device includes clamping drive systems, lifting drive systems, an upper rim burr removing system, a valve hole burr removing system, a rotary switching system and the like, which in use can simultaneously remove burrs on two wheels having different heights and different diameters at the end face of the upper rim, the valve hole, the lateral cutting position of the upper rim and the riser.

1 Claim, 7 Drawing Sheets

(56) References Cited

FOREIGN PATENT DOCUMENTS

| | | | |
|---|---|---|---|
| JP | 3044289 | B2 * | 5/2000 |
| JP | 3091417 | B2 * | 9/2000 |

* cited by examiner

DOUBLE-STATION WHEEL BURR REMOVING DEVICE

CROSS-REFERENCE TO RELATED APPLICATIONS

This application is filed based upon and claims priority to Chinese Patent Application No. 201710167295.5, filed on Mar. 20, 2017, the entire contents of which are incorporated herein by reference.

TECHNICAL FIELD

The disclosure relates to a burr removing device, and specifically to a double-station wheel burr removing device.

BACKGROUND

In the machining process of an aluminum alloy wheel, because the cutting positions are different, burrs having different sizes are often formed on the end face of the upper rim, the side of the upper rim, the riser and the valve hole; besides, burrs exist after machining of each wheel, and a larger amount of burrs need to be removed if the yield is larger. Therefore, needed is an automatic burr removing device, which can simultaneously remove burrs formed on the end face of the upper rim, the side of the upper rim, the riser and the valve hole and simultaneously has very high removal efficiency; thus, the burr removing device put forward by the disclosure completely can meet the requirements of production.

SUMMARY

A wheel burr removing device is provided, which may capable of, among other things, simultaneously removing burrs on two wheels having different heights and different diameters at the end face of the upper rim, the valve hole, the lateral cutting position of the upper rim and the riser.

In one embodiment of the disclosure, a double-station wheel burr removing device is composed of a frame (1), a first servo motor (2), a right shaft (3), a right bearing seat (4), a fixed plate (5), a first guide rail (6), a left sliding plate (7), a left shaft (8), a left bearing seat (9), a first electric servo cylinder (10), a V-shaped roller (11), a conical brush (12), a transmission shaft (13), an upper bearing seat (14), a first lifting plate (15), a second servo motor (16), a sliding table (17), a guide sleeve (18), a guide post (19), a cylinder (20), a second electric servo cylinder (21), a second guide rail (22), a third servo motor (23), a platform (24), a turntable (25), a swivel (26), a third guide rail (27), a left bottom plate (28), an third electric servo cylinder (29), a left vertical plate (30), a fourth guide rail (31), a second lifting plate (32), a fourth servo motor (33), a first bearing seat (34), a first shaft (35), a turnover rack (36), a left brush (37), a first belt pulley (38), a first synchronous belt (39), a second belt pulley (40), a fifth servo motor (41), an fourth electric servo cylinder (42), an fifth electric servo cylinder (43), a fifth guide rail (44), a right vertical plate (45), a third lifting plate (46), a sixth servo motor (47), a rotating plate (48), a seventh servo motor (49), a third belt pulley (50), a flexible grinding head (51), a second bearing seat (52), a second shaft (53), a second synchronous belt (54), a fourth belt pulley (55), an sixth electric servo cylinder (56), a right bottom plate (57), a fixed block (58), a sixth guide rail (59), a right conical brush (121), a right transmission shaft (131), a right upper bearing seat (141), a first right lifting plate (151), a second right servo motor (161), a right sliding table (171), a right guide sleeve (181), a right guide post (191), a right cylinder (201), a second right electric servo cylinder (211), a second right guide rail (221), a first right servo motor (212), a second right shaft (311), a second right bearing seat (411), a right fixed plate (511), a first right guide rail (611), a second left sliding plate (711), a second left shaft (811), a second left bearing seat (911), a first right electric servo cylinder (101), a right V-shaped roller (111) and the like.

A clamping drive system includes: the fixed plate (5) is fixed on the frame (1); the left sliding plate (7) is installed above the fixed plate (5) via the first guide rail (6); two left bearing seats (9) are fixed on the left sliding plate (7); at the tops of the two left shafts (8) are respectively fixed a V-shaped roller (11), and the two left shafts (8) are installed inside the left bearing seats (9); the first electric servo cylinder (10) is fixed on the left of the frame (1), and the output end of the first electric servo cylinder (10) is connected with the left sliding plate (7); two right bearing seats (4) are fixed above the fixed plate (5); two right shafts (3) are installed inside the two right bearing seats (4) via bearings, and a V-shaped roller (11) is respectively fixed at the tops of the two right shafts (3); the first servo motor (2) is fixed below the fixed plate (5), and the output end of the first servo motor (2) is connected with the lower part of one of the right shafts (3).

A second clamping drive system includes: the right fixed plate (511) is fixed on the frame (1); the second left sliding plate (711) is installed above the right fixed plate (511) via the first right guide rail (611); two second left bearing seats (911) are fixed on the second left sliding plate (711); at the tops of the two second left shafts (811) are respectively fixed a right V-shaped roller (111), and the two second left shafts (811) are installed inside the second left bearing seats (911); the first right electric servo cylinder (101) is fixed on the left of the frame (1), and the output end of the first right electric servo cylinder (101) is connected with the second left sliding plate (711); two second right bearing seats (411) are fixed above the right fixed plate (511); two second right shafts (311) are installed inside the two second right bearing seats (411) via bearings, and a right V-shaped roller (111) is respectively fixed at the tops of the two second right shafts (311); the first right servo motor (212) is fixed below the right fixed plate (511), and the output end of the first right servo motor (212) is connected with the lower part of one of the second right shafts (311).

A lifting drive system includes: the upper bearing seat (14) is fixed below the first lifting plate (15); the transmission shaft (13) is installed inside the upper bearing seat (14) via a bearing; the conical brush (12) is fixed below the transmission shaft (13); the second servo motor (16) is fixed in the middle above the first lifting plate (15), and the output end of the second servo motor (16) is connected with the top of the transmission shaft (13); four guide posts (19) are fixed above the first lifting plate (15); four guide sleeves (18) are fixed on a bottom plate of the sliding table (17), and matched with the four guide posts (19); two cylinders (20) are also fixed on the bottom plate of the sliding table (17), and the output ends of the two cylinders (20) are articulated with the upper end of the first lifting plate (15); the top of the sliding table (17) is installed below the top of the frame (1) via the second guide rail (22); the second electric servo cylinder (21) is fixed on the side of the frame (1), and the output end of the second electric servo cylinder (21) is connected with the sliding table (17).

A second lifting drive system includes: the right upper bearing seat (141) is fixed below the first right lifting plate (151); the right transmission shaft (131) is installed inside the right upper bearing seat (141) via a bearing; the right conical brush (121) is fixed below the right transmission shaft (131); the second right servo motor (161) is fixed in the middle above the first right lifting plate (151), and the output end of the second right servo motor (161) is connected with the top of the right transmission shaft (131); four right guide posts (191) are fixed above the first right lifting plate (151); four right guide sleeves (181) are fixed on a bottom plate of the right sliding table (171), and matched with the four right guide posts (191); two right cylinders (201) are also fixed on the bottom plate of the right sliding table (171), and the output ends of the two right cylinders (201) are articulated with the upper end of the first right lifting plate (151); the top of the right sliding table (171) is installed below the top of the frame (1) via the second right guide rail (221); the second right electric servo cylinder (211) is fixed on the side of the frame (1), and the output end of the second right electric servo cylinder (211) is connected with the right sliding table (171).

An upper rim burr removing system includes: the left bottom plate (28) is installed above the turntable (25) via the third guide rail (27); the third electric servo cylinder (29) is fixed above the left bottom plate (28), and the output end of the third electric servo cylinder (29) is connected with the left side of the fixed block (58); the fixed block (58) is fixed in the middle above the turntable (25); the left vertical plate (30) is fixed above the left bottom plate (28); the second lifting plate (32) is installed on the left of the left vertical plate (30) via the fourth guide rail (31); the fourth electric servo cylinder (42) is fixed at the top of the left vertical plate (30), and the output end of the fourth electric servo cylinder (42) is connected with the top of the second lifting plate (32); the first bearing seat (34) is fixed on the left of the second lifting plate (32); the first shaft (35) is installed inside the first bearing seat (34) via a bearing; the fourth servo motor (33) is fixed on the right of the second lifting plate (32); the output end of the fourth servo motor (33) is connected with the right end of the first shaft (35); the turnover rack (36) is fixed on the left of the first shaft (35); the left brush (37) is installed on the left of the turnover rack (36) via a bearing, and the first belt pulley (38) is installed at the top of the left brush (37); the fifth servo motor (41) is fixed at the top of the turnover rack (36), and the second belt pulley (40) is installed at the output end of the fifth servo motor (41); and the first belt pulley (38) is connected with the second belt pulley (40) via the first synchronous belt (39).

A valve hole burr removing system includes: the right bottom plate (57) is installed above the turntable (25) via the sixth guide rail (59); the sixth electric servo cylinder (56) is fixed above the right bottom plate (57), and the output end of the sixth electric servo cylinder (56) is connected with the right side of the fixed block (58); the right vertical plate (45) is fixed above the right bottom plate (57); the third lifting plate (46) is installed on the right of the right vertical plate (45) via the fifth guide rail (44); the fifth electric servo cylinder (43) is fixed at the top of the right vertical plate (45), and the output end of the fifth electric servo cylinder (43) is connected with the third lifting plate (46); the rotating plate (48) is installed inside the third lifting plate (46) via a pin roll; the sixth servo motor (47) is fixed on the side of the third lifting plate (46), and the output end of the sixth servo motor (47) is connected with the pin roll in the center of the rotating plate (48); the seventh servo motor (49) is fixed at the top of the rotating plate (48), and the third belt pulley (50) is fixed at the output end of the seventh servo motor (49); the second bearing seat (52) is installed at one end of the rotating plate (48); the second shaft (53) is installed inside the second bearing seat (52) via a bearing; the fourth belt pulley (55) is fixed below the second shaft (53); the flexible grinding head (51) is installed at the top of the second shaft (53); and the third belt pulley (50) is connected with the fourth belt pulley (55) via the second synchronous belt (54).

A rotary switching system includes: the platform (24) is fixed between the left clamping drive system and the right clamping drive system; the third servo motor (23) is fixed below the platform (24); the turntable (25) is installed above the platform (24) via the swivel (26); and the output end of the third servo motor (23) is connected with the lower part of the turntable (25).

In practical use, the first electric servo cylinder drives the two left bearing seats to move right via the first guide rail, the four V-shaped rollers clamp a wheel at the left side, and the first servo motor drives the clamped wheel to rotate; according to different wheel diameter, the second electric servo cylinder drives the conical brush via the second guide rail to move to a position above the riser of the wheel at the left side, the second servo motor drives the conical brush to rotate via the transmission shaft, the cylinders drive the conical brush to decline via the guide posts, and when the conical brush contacts the riser of the wheel at the left side, burrs thereon can be removed.

The first right electric servo cylinder drives the two second left bearing seats to move left via the first right guide rail, the four right V-shaped rollers clamp a wheel at the right side, and the first right servo motor drives the clamped wheel to rotate; according to different wheel diameter, the second right electric servo cylinder drives the right conical brush via the second right guide rail to move to a position above the riser of the wheel at the right side, the second right servo motor drives the right conical brush to rotate via the right transmission shaft, the right cylinders drive the right conical brush to decline via the right guide posts, and when the right conical brush contacts the riser of the wheel at the right side, burrs thereon can be removed.

The third electric servo cylinder drives the left brush to move left via the third guide rail; the fourth electric servo cylinder drives the left brush to decline via the fourth guide rail, the fifth servo motor drives the left brush to rotate via the first synchronous belt, and when the rotating left brush contacts the end face of the upper rim of the wheel, burrs thereon can be removed; the fourth servo motor drives the left brush to rotate 90 degrees via the first shaft, and when the left brush contacts the side of the upper rim of the wheel, burrs thereon can be removed; the sixth electric servo cylinder drives the flexible grinding head to move right via the sixth guide rail, the flexible grinding head can be adjusted to an appropriate height by the fifth electric servo cylinder via the fifth guide rail, the sixth electric servo cylinder can drive the flexible grinding head to rotate to an appropriate angle, the seventh servo motor drives the flexible grinding head to rotate via the second synchronous belt, and when the rotating flexible grinding head contacts the valve hole of the right wheel, burrs thereon can be removed; the upper rim burr removing system and the valve hole burr removing system can be switched by the third servo motor via the swivel to remove burrs at specific positions of the wheel on the other side.

The double-station wheel burr removing device of the disclosure in use can simultaneously remove burrs on two wheels having different heights and different diameters at the end face of the upper rim, the valve hole, the lateral cutting position of the upper rim and the riser, so the production efficiency is very high; and simultaneously, the device has the characteristics of high automation degree, advanced process, strong generality, safety and stability.

Figure 1:
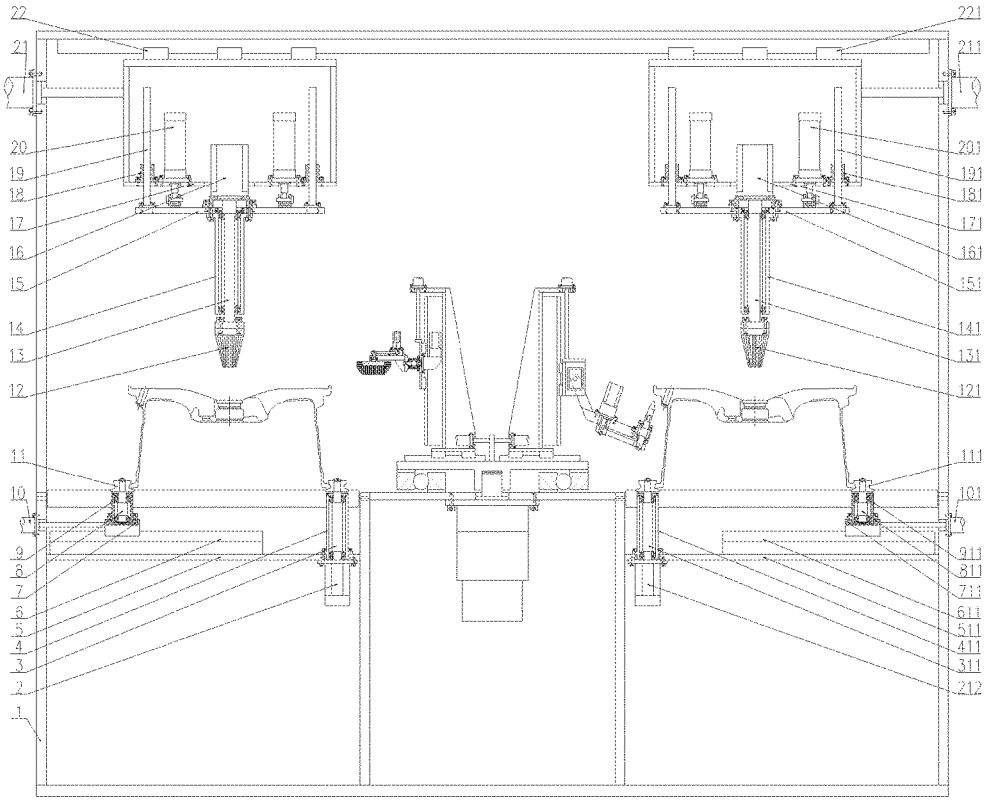
FIG. 1 is a front view of a double-station wheel burr removing device including clamping drive systems, lifting drive systems, an upper rim burr removing system, a valve hole burr removing system, and a rotary switching system of the disclosure.
Figure 2:
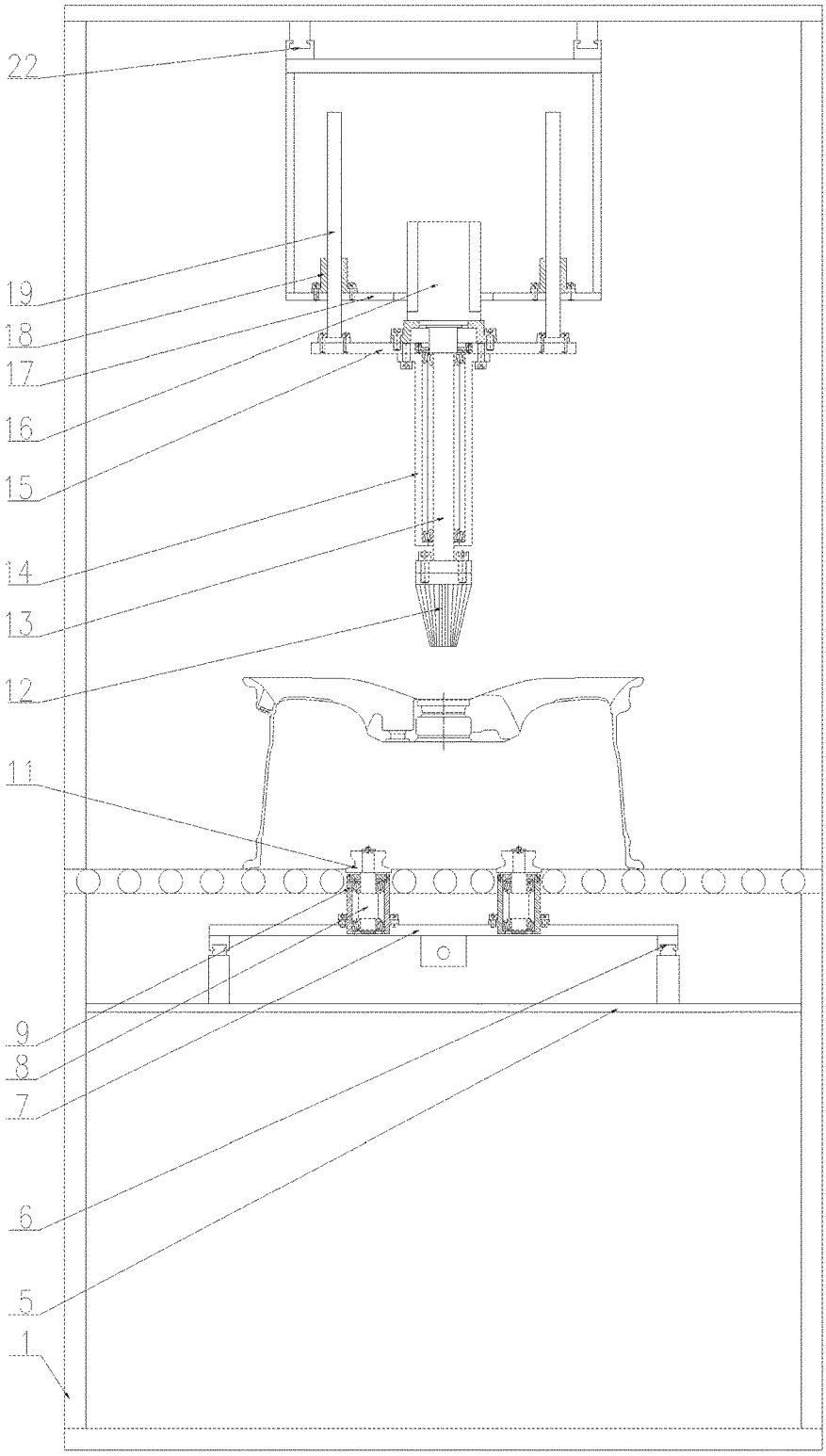
FIG. 2 is a left view of the double-station wheel burr removing device including clamping drive systems, lifting drive systems, an upper rim burr removing system, a valve hole burr removing system, and a rotary switching system of the disclosure.
Figure 3:
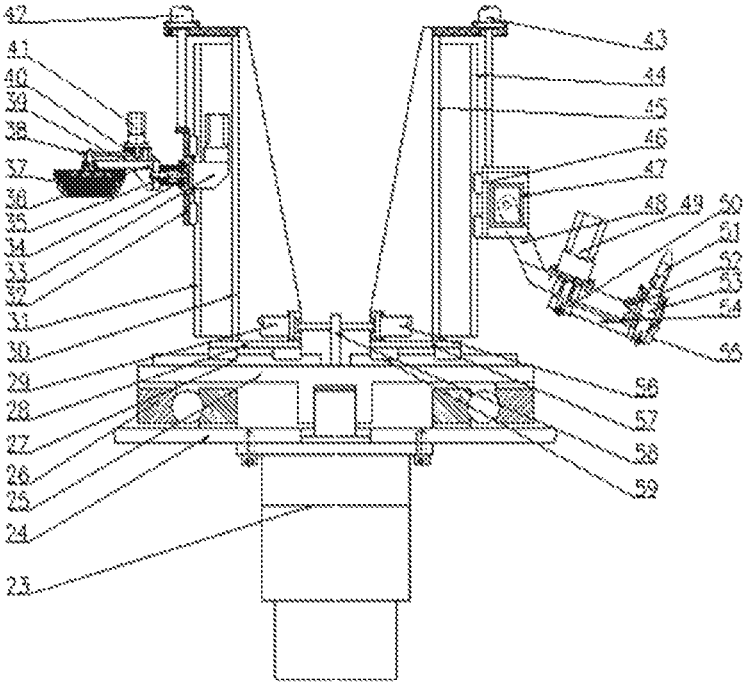
FIG. 3 is a partial front view of the upper rim burr removing system and the valve hole burr removing system of the double-station wheel burr removing device of the disclosure.
Figure 4:
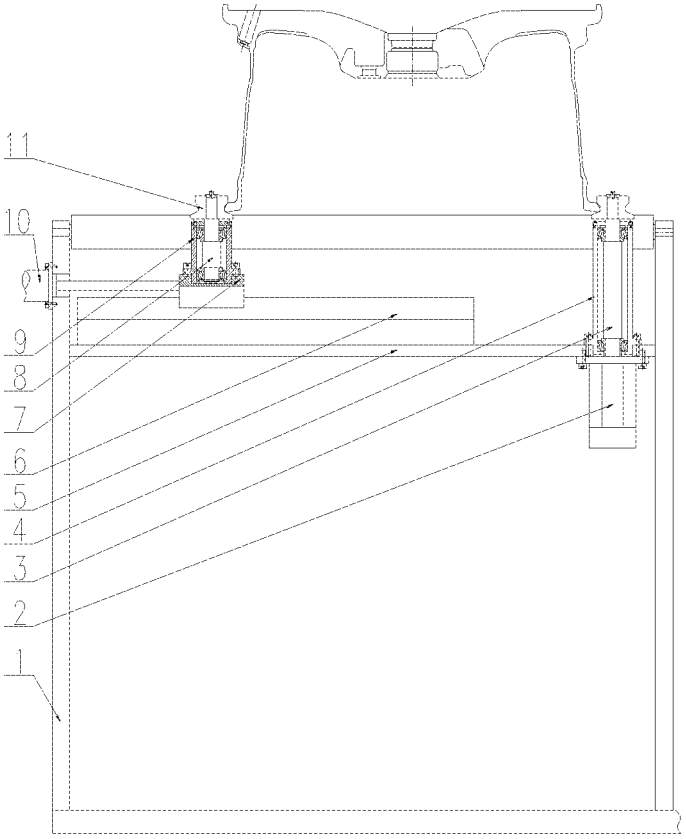
FIG. 4 is a front view of the clamping drive system of the double-station wheel burr removing device of the disclosure.
Figure 5:
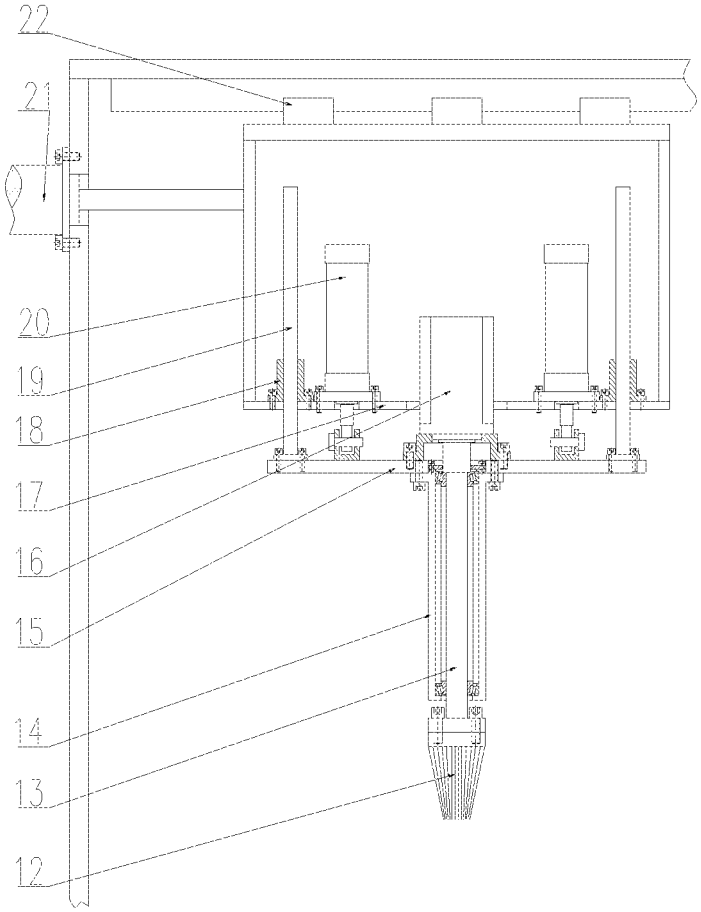
FIG. 5 is a front view of the lifting drive system of the double-station wheel burr removing device of the disclosure.
Figure 6:
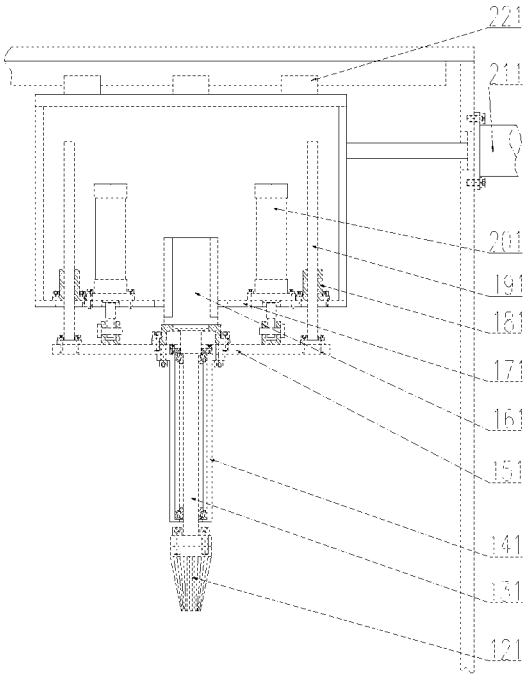
FIG. 6 is a front view of the second lifting drive system of the double-station wheel burr removing device of the disclosure.
Figure 7:
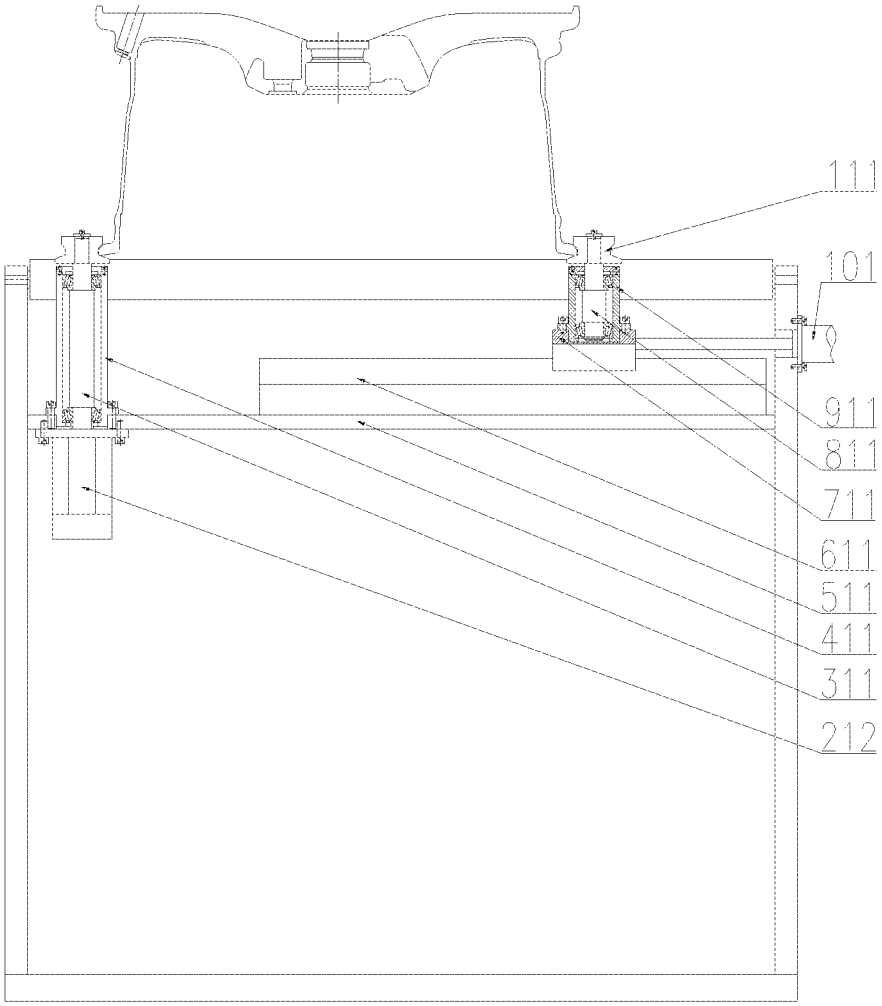
FIG. 7 is a front view of the second clamping drive system of the double-station wheel burr removing device of the disclosure.

In the figures, 1—frame, 2—first servo motor, 3—right shaft, 4—right bearing seat, 5—fixed plate, 6—first guide rail, 7—left sliding plate, 8—left shaft, 9—left bearing seat, 10—*a* first electric servo cylinder, 11—V—shaped roller, 12—conical brush, 13—transmission shaft, 14—upper bearing seat, 15—first lifting plate, 16—second servo motor, 17—sliding table, 18—guide sleeve, 19—guide post, 20—cylinder, 21—second electric servo cylinder, 22—second guide rail, 23—third servo motor, 24—platform, 25—turntable, 26—swivel, 27—third guide rail, 28—left bottom plate, 29—third electric servo cylinder, 30—left vertical plate, 31—fourth guide rail, 32—second lifting plate, 33—fourth servo motor, 34—first bearing seat, 35—first shaft, 36—turnover rack, 37—left brush, 38—first belt pulley, 39—first synchronous belt, 40—second belt pulley, 41—fifth servo motor, 42—fourth electric servo cylinder, 43—fifth electric servo cylinder, 44—fifth guide rail, 45—right vertical plate, 46—third lifting plate, 47—sixth servo motor, 48—rotating plate, 49—seventh servo motor, 50—third belt pulley, 51—flexible grinding head, 52—second bearing seat, 53—second shaft, 54—second synchronous belt, 55—fourth belt pulley, 56—sixth electric servo cylinder, 57—right bottom plate, 58—fixed block, 59—sixth guide rail, 121—right conical brush, 131—right transmission shaft, 141—right upper bearing seat, 151—first right lifting plate, 161—second right servo motor, 171—right sliding table, 181—right guide sleeve, 191—right guide post, 201—right cylinder, 211—second right electric servo cylinder, 221—second right guide rail, 212—first right servo motor, 311—second right shaft, 411—second right bearing seat, 511—right fixed plate, 611—first right guide rail, 711—second left sliding plate, 811—second left shaft, 911—second left bearing seat, 101—first right electric servo cylinder, 111—right V—shaped roller.

DETAILED DESCRIPTION

Details and working conditions of a specific device provided by the disclosure will be described below in combination with the accompanying drawings.

The device is composed of a frame 1, a first servo motor 2, right shafts 3, a right bearing seat 4, a fixed plate 5, a first guide rail 6, a left sliding plate 7, a left shaft 8, a left bearing seat 9, a first electric servo cylinder 10, a V-shaped roller 11, a conical brush 12, a transmission shaft 13, a upper bearing seat 14, a first lifting plate 15, a second servo motor 16, a sliding table 17, a guide sleeve 18, a guide post 19, a cylinder 20, a second electric servo cylinder 21, a second guide rail 22, a third servo motor 23, a platform 24, a turntable 25, a swivel 26, a third guide rail 27, a left bottom plate 28, an third electric servo cylinder 29, a left vertical plate 30, a fourth guide rail 31, a second lifting plate 32, a fourth servo motor 33, a first bearing seat 34, a first shaft 35, a turnover rack 36, a left brush 37, a first belt pulley 38, a first synchronous belt 39, a second belt pulley 40, a fifth servo motor 41, an fourth electric servo cylinder 42, an fifth electric servo cylinder 43, a fifth guide rail 44, a right vertical plate 45, a third lifting plate 46, a sixth servo motor 47, a rotating plate 48, a seventh servo motor 49, a third belt pulley 50, a flexible grinding head 51, a second bearing seat 52, a second shaft 53, a second synchronous belt 54, a fourth belt pulley 55, an sixth electric servo cylinder 56, a right bottom plate 57, a fixed block 58, a sixth guide rail 59, a right conical brush 121, a right transmission shaft 131, a right upper bearing seat 141, a first right lifting plate 151, a second right servo motor 161, a right sliding table 171, a right guide sleeve 181, a right guide post 191, a right cylinder 201, a second right electric servo cylinder 211, a second right guide rail 221, a first right servo motor 212, a second right shaft 311, a second right bearing seat 411, a right fixed plate 511, a first right guide rail 611, a second left sliding plate 711, a second left shaft 811, a second left bearing seat 911, a first right electric servo cylinder 101, a right V-shaped roller 111 and the like.

A clamping drive system includes: the fixed plate 5 is fixed on the frame 1; the left sliding plate 7 is installed above the fixed plate 5 via the first guide rail 6; two left bearing seats 9 are fixed on the left sliding plate 7; at the tops of the two left shafts 8 are respectively fixed a V-shaped roller 11, and the two left shafts 8 are installed inside the left bearing seats 9; the first electric servo cylinder 10 is fixed on the left of the frame 1, and the output end of the first electric servo cylinder 10 is connected with the left sliding plate 7; two right bearing seats 4 are fixed above the fixed plate 5; two right shafts 3 are installed inside the two right bearing seats 4 via bearings, and a V-shaped roller 11 is respectively fixed at the tops of the two right shafts 3; the first servo motor 2 is fixed below the fixed plate 5, and the output end of the first servo motor 2 is connected with the lower part of one of the right shafts 3.

A second clamping drive system includes: the right fixed plate 511 is fixed on the frame 1; the second left sliding plate 711 is installed above the right fixed plate 511 via the first right guide rail 611; two second left bearing seats 911 are fixed on the second left sliding plate 711; at the tops of the two second left shafts 811 are respectively fixed a right V-shaped roller 111, and the two second left shafts 811 are installed inside the second left bearing seats 911; the first right electric servo cylinder 101 is fixed on the left of the frame 1, and the output end of the first right electric servo cylinder 101 is connected with the second left sliding plate 711; two second right bearing seats 411 are fixed above the right fixed plate 511; two second right shafts 311 are installed inside the two second right bearing seats 411 via bearings, and a right V-shaped roller 111 is respectively fixed at the tops of the two second right shafts 311; the first right servo motor 212 is fixed below the right fixed plate 511, and the output end of the first right servo motor 212 is connected with the lower part of one of the second right shafts 311.

A lifting drive system includes: the upper bearing seat 14 is fixed below the first lifting plate 15; the transmission shaft 13 is installed inside the upper bearing seat 14 via a bearing; the conical brush 12 is fixed below the transmission shaft 13; the second servo motor 16 is fixed in the middle above the first lifting plate 15, and the output end of the second servo motor 16 is connected with the top of the transmission shaft 13; four guide posts 19 are fixed above the first lifting plate 15; four guide sleeves 18 are fixed on a bottom plate of the sliding table 17, and matched with the four guide posts 19; two cylinders 20 are also fixed on the bottom plate of the sliding table 17, and the output ends of the two cylinders 20 are articulated with the upper end of the first lifting plate 15; the top of the sliding table 17 is installed below the top of the frame 1 via the second guide rail 22; the second electric servo cylinder 21 is fixed on the side of the frame 1, and the output end of the second electric servo cylinder 21 is connected with the sliding table 17.

A second lifting drive system includes: the right upper bearing seat 141 is fixed below the first right lifting plate 151; the right transmission shaft 131 is installed inside the right upper bearing seat 141 via a bearing; the right conical brush 121 is fixed below the right transmission shaft 131; the second right servo motor 161 is fixed in the middle above the first right lifting plate 151, and the output end of the second right servo motor 161 is connected with the top of the right transmission shaft 131; four right guide posts 191 are fixed above the first right lifting plate 151; four right guide sleeves 181 are fixed on a bottom plate of the right sliding table 171, and matched with the four right guide posts 191; two right cylinders 201 are also fixed on the bottom plate of the right sliding table 171, and the output ends of the two right cylinders 201 are articulated with the upper end of the first right lifting plate 151; the top of the right sliding table 171 is installed below the top of the frame 1 via the second right guide rail 221; the second right electric servo cylinder 211 is fixed on the side of the frame 1, and the output end of the second right electric servo cylinder 211 is connected with the right sliding table 171.

An upper rim burr removing system includes: the left bottom plate 28 is installed above the turntable 25 via the third guide rail 27; the third electric servo cylinder 29 is fixed above the left bottom plate 28, and the output end of the third electric servo cylinder 29 is connected with the left side of the fixed block 58; the fixed block 58 is fixed in the middle above the turntable 25; the left vertical plate 30 is fixed above the left bottom plate 28; the second lifting plate 32 is installed on the left of the left vertical plate 30 via the fourth guide rail 31; the fourth electric servo cylinder 42 is fixed at the top of the left vertical plate 30, and the output end of the fourth electric servo cylinder 42 is connected with the top of the second lifting plate 32; the first bearing seat 34 is fixed on the left of the second lifting plate 32; the first shaft 35 is installed inside the first bearing seat 34 via a bearing; the fourth servo motor 33 is fixed on the right of the second lifting plate 32; the output end of the fourth servo motor 33 is connected with the right end of the first shaft 35; the turnover rack 36 is fixed on the left of the first shaft 35; the left brush 37 is installed on the left of the turnover rack 36 via a bearing, and the first belt pulley 38 is installed at the top of the left brush 37; the fifth servo motor 41 is fixed at the top of the turnover rack 36, and the second belt pulley 40 is installed at the output end of the fifth servo motor 41; and the first belt pulley 38 is connected with the second belt pulley 40 via the first synchronous belt 39.

A valve hole burr removing system includes: the right bottom plate 57 is installed above the turntable 25 via the sixth guide rail 59; the sixth electric servo cylinder 56 is fixed above the right bottom plate 57, and the output end of the sixth electric servo cylinder 56 is connected with the right side of the fixed block 58; the right vertical plate 45 is fixed above the right bottom plate 57; the third lifting plate 46 is installed on the right of the right vertical plate 45 via the fifth guide rail 44; the fifth electric servo cylinder 43 is fixed at the top of the right vertical plate 45, and the output end of the fifth electric servo cylinder 43 is connected with the third lifting plate 46; the rotating plate 48 is installed inside the third lifting plate 46 via a pin roll; the sixth servo motor 47 is fixed on the side of the third lifting plate 46, and the output end of the sixth servo motor 47 is connected with the pin roll in the center of the rotating plate 48; the seventh servo motor 49 is fixed at the top of the rotating plate 48, and the third belt pulley 50 is fixed at the output end of the seventh servo motor 49; the second bearing seat 52 is installed at one end of the rotating plate 48; the second shaft 53 is installed inside the second bearing seat 52 via a bearing; the fourth belt pulley 55 is fixed below the second shaft 53; the flexible grinding head 51 is installed at the top of the second shaft 53; and the third belt pulley 50 is connected with the fourth belt pulley 55 via the second synchronous belt 54.

A rotary switching system includes: the platform 24 is fixed between the left clamping drive system and the right clamping drive system; the third servo motor 23 is fixed below the platform 24; the turntable 25 is installed above the platform 24 via the swivel 26; and the output end of the third servo motor 23 is connected with the lower part of the turntable 25.

In the working process, the first electric servo cylinder 10 drives the two left bearing seats 9 to move right via the first guide rail 6, the four V-shaped rollers 11 clamp a wheel at the left side, and the first servo motor 2 drives the clamped wheel to rotate; according to different wheel diameter, the second electric servo cylinder 21 drives the conical brush 12 via the second guide rail 22 to move to a position above the riser of the wheel at the left side, the second servo motor 16 drives the conical brush 12 to rotate via the transmission shaft 13, the cylinders 20 drive the conical brush 12 to decline via the guide posts 19, and when the conical brush 12 contacts the riser of the wheel, burrs thereon can be removed.

The first right electric servo cylinder 101 drives the two second left bearing seats 911 to move left via the first right guide rail 611, the four right V-shaped rollers 111 clamp a wheel at the right side, and the first right servo motor 212 drives the clamped wheel to rotate; according to different wheel diameter, the second right electric servo cylinder 211 drives the right conical brush 121 via the second right guide rail 221 to move to a position above the riser of the wheel at the right side, the second right servo motor 161 drives the right conical brush 121 to rotate via the right transmission shaft 131, the right cylinders 201 drive the right conical brush 121 to decline via the right guide posts 191, and when the right conical brush 121 contacts the riser of the wheel at the right side, burrs thereon can be removed.

The third electric servo cylinder 29 drives the left brush 37 to move left via the third guide rail 27; the fourth electric servo cylinder 42 drives the left brush 37 to decline via the fourth guide rail 31, the fifth servo motor 41 drives the left brush 37 to rotate via the first synchronous belt 39, and when the rotating left brush 37 contacts the end face of the upper rim of the wheel, burrs thereon can be removed; the fourth servo motor 33 drives the left brush 37 to rotate 90 degrees via the first shaft 35, and when the left brush 37 contacts the side of the upper rim of the wheel, burrs thereon can be removed; the sixth electric servo cylinder 56 drives the flexible grinding head 51 to move right via the sixth guide rail 59, the flexible grinding head 51 can be adjusted to an appropriate height by the fifth electric servo cylinder 43 via the fifth guide rail 44, the sixth electric servo motor 47 can drive the flexible grinding head 51 to rotate to an appropriate angle, the seventh servo motor 49 drives the flexible grinding head 51 to rotate via the second synchronous belt 54, and when the rotating flexible grinding head 51 contacts the valve hole of the right wheel, burrs thereon can be removed; the upper rim burr removing system and the valve hole burr removing system can be switched by the third servo motor 23 via the swivel 26 to remove burrs at specific positions of the wheel on the other side.

What is claimed is:

1. A double-station wheel burr removing device, comprising a frame, a first servo motor, a right shaft, a right bearing seat, a fixed plate, a first guide rail, a left sliding plate, two left shafts, a left bearing seat, a first electric servo cylinder, four V-shaped rollers, a conical brush, a transmission shaft, an upper bearing seat, a first lifting plate, a second servo motor, a sliding table, a guide sleeve, a guide post, a cylinder, a second electric servo cylinder, a second guide rail, a third servo motor, a platform, a turntable, a swivel, a third guide rail, a left bottom plate, a third electric servo cylinder, a left vertical plate, a fourth guide rail, a second lifting plate, a fourth servo motor, a first bearing seat, a first shaft, a turnover rack, a left brush, a first belt pulley, a first synchronous belt, a second belt pulley, a fifth servo motor, a fourth electric servo cylinder, a fifth electric servo cylinder, a fifth guide rail, a right vertical plate, a third lifting plate, a sixth servo motor, a rotating plate, a seventh servo motor, a third belt pulley, a flexible grinding head, a second bearing seat, a second shaft, a second synchronous belt, a fourth belt pulley, a sixth electric servo cylinder, a right bottom plate, a fixed block, a sixth guide rail, a right conical brush, a right transmission shaft, a right upper bearing seat, a first right lifting plate, a second right servo motor, a right sliding table, a right guide sleeve, a right guide post, a right cylinder, a second right electric servo cylinder, a second right guide rail, a first right servo motor, a second right shaft, a second right bearing seat, a right fixed plate, a first right guide rail, a second left sliding plate, two second left shafts, a second left bearing seat, a first right electric servo cylinder, four right V-shaped roller, wherein a clamping drive system comprises: the fixed plate is fixed on the frame; the left sliding plate is installed above the fixed plate via the first guide rail; two left bearing seats are fixed on the left sliding plate; at the tops of the two left shafts are respectively fixed one of the four V-shaped rollers and the two left shafts are installed inside the left bearing seats; the first electric servo cylinder is fixed on the left of the frame, and the output end of the first electric servo cylinder is connected with the left sliding plate; two right bearing seats are fixed above the fixed plate; two right shafts are installed inside the two right bearing seats via bearings, and one of the four V-shaped rollers is respectively fixed at the tops of the two right shafts; the first servo motor is fixed below the fixed plate, and the output end of the first servo motor is connected with the lower part of one of the right shafts;

a second clamping drive system comprises: the right fixed plate is fixed on the frame; the second left sliding plate is installed above the right fixed plate via the first right guide rail; two second left bearing seats are fixed on the second left sliding plate; at the tops of the two second left shafts are respectively fixed one of the four right V-shaped rollers, and the two second left shafts are installed inside the second left bearing seats; the first right electric servo cylinder is fixed on the left of the frame, and the output end of the first right electric servo cylinder is connected with the second left sliding plate; two second right bearing seats are fixed above the right fixed plate; two second right shafts are installed inside the two second right bearing seats via bearings, and one of the four right V-shaped roller is respectively fixed at the tops of the two second right shafts; the first right servo motor is fixed below the right fixed plate, and the output end of the first right servo motor is connected with the lower part of one of the second right shafts;

a lifting drive system comprises: the upper bearing seat is fixed below the first lifting plate; the transmission shaft is installed inside the upper bearing seat via a bearing; the conical brush is fixed below the transmission shaft; the second servo motor is fixed in the middle above the first lifting plate, and the output end of the second servo motor is connected with the top of the transmission shaft; four guide posts are fixed above the first lifting plate; four guide sleeves are fixed on a bottom plate of the sliding table, and matched with the four guide posts; two cylinders are also fixed on the bottom plate of the sliding table, and the output ends of the two cylinders are articulated with the upper end of the first lifting plate; the top of the sliding table is installed below the top of the frame via the second guide rail; the second electric servo cylinder is fixed on the side of the frame, and the output end of the second electric servo cylinder is connected with the sliding table;

a second lifting drive system comprises: the right upper bearing seat is fixed below the first right lifting plate; the right transmission shaft is installed inside the right upper bearing seat via a bearing; the right conical brush is fixed below the right transmission shaft; the second right servo motor is fixed in the middle above the first right lifting plate, and the output end of the second right servo motor is connected with the top of the right transmission shaft; four right guide posts are fixed above the first right lifting plate; four right guide sleeves are fixed on a bottom plate of the right sliding table, and matched with the four right guide posts; two right cylinders are also fixed on the bottom plate of the right sliding table, and the output ends of the two right cylinders are articulated with the upper end of the first right lifting plate; the top of the right sliding table is installed below the top of the frame via the second right guide rail; the second right electric servo cylinder is fixed on the side of the frame, and the output end of the second right electric servo cylinder is connected with the right sliding table;

an upper rim burr removing system comprises: the left bottom plate is installed above the turntable via the third guide rail; the third electric servo cylinder is fixed above the left bottom plate, and the output end of the third electric servo cylinder is connected with the left side of the fixed block; the fixed block is fixed in the middle above the turntable; the left vertical plate is fixed above the left bottom plate; the second lifting plate is installed on the left of the left vertical plate via the fourth guide rail; the fourth electric servo cylinder is fixed at the top of the left vertical plate, and the output end of the fourth electric servo cylinder is connected with the top of the second lifting plate; the first bearing seat is fixed on the left of the second lifting plate; the first shaft is installed inside the first bearing seat via a bearing; the fourth servo motor is fixed on the right of the second lifting plate; the output end of the fourth servo motor is connected with the right end of the first shaft; the turnover rack is fixed on the left of the first shaft; the left brush is installed on the left of the turnover rack via a bearing, and the first belt pulley is installed at the top of the left brush; the fifth servo motor is fixed at the top of the turnover rack, and the second belt pulley is installed at the output end of the fifth servo motor; the first belt pulley is connected with the second belt pulley via the first synchronous belt;

a valve hole burr removing system comprises: the right bottom plate is installed above the turntable via the sixth guide rail; the sixth electric servo cylinder is fixed above the right bottom plate, and the output end of the sixth electric servo cylinder is connected with the right side of the fixed block; the right vertical plate is fixed above the right bottom plate; the third lifting plate is installed on the right of the right vertical plate via the fifth guide rail; the fifth electric servo cylinder is fixed at the top of the right vertical plate, and the output end of the fifth electric servo cylinder is connected with the third lifting plate; the rotating plate is installed inside the third lifting plate via a pin roll; the sixth servo motor is fixed on the side of the third lifting plate, and the output end of the sixth servo motor is connected with the pin roll in the center of the rotating plate; the seventh servo motor is fixed at the top of the rotating plate, and the third belt pulley is fixed at the output end of the seventh servo motor; the second bearing seat is installed at one end of the rotating plate; the second shaft is installed inside the second bearing seat via a bearing; the fourth belt pulley is fixed below the second shaft; the flexible grinding head is installed at the top of the second shaft; the third belt pulley is connected with the fourth belt pulley via the second synchronous belt; and a rotary switching system comprises: the platform is fixed between the clamping drive system and the second clamping drive system; the third servo motor is fixed below the platform; the turntable is installed above the platform via the swivel; and the output end of the third servo motor is connected with the lower part of the turntable;

in a working process, the first electric servo cylinder drives the two left bearing seats to move right via the first guide rail, the four V-shaped rollers clamp a wheel at the left side, and the first servo motor drives the clamped wheel to rotate; according to different wheel diameter, the second electric servo cylinder drives the conical brush via the second guide rail to move to a position above a riser of the wheel at the left side, the second servo motor drives the conical brush to rotate via the transmission shaft, the two cylinders drive the conical brush to decline via the four guide posts, and when the conical brush contacts the riser of the wheel at the left side, burrs thereon can be removed;

the first right electric servo cylinder drives the two second left bearing seats to move left via the first right guide rail, the four right V-shaped rollers clamp a wheel at the right side, and the first right servo motor drives the clamped wheel to rotate; according to different wheel diameter, the second right electric servo cylinder drives the right conical brush via the second right guide rail to move to a position above a riser of the wheel at the right side, the second right servo motor drives the right conical brush to rotate via the right transmission shaft, the two right cylinders drive the right conical brush to decline via the four right guide posts, and when the right conical brush contacts the riser of the wheel at the right side, burrs thereon can be removed;

the third electric servo cylinder drives the left brush to move left via the third guide rail; the fourth electric servo cylinder drives the left brush to decline via the fourth guide rail, the fifth servo motor drives the left brush to rotate via the first synchronous belt, and when the rotating left brush contacts the end face of the upper rim of the wheel, burrs thereon can be removed; the fourth servo motor drives the left brush to rotate 90 degrees via the first shaft, and when the left brush contacts the side of the upper rim of the wheel, burrs thereon can be removed; the sixth electric servo cylinder drives the flexible grinding head to move right via the sixth guide rail, the flexible grinding head can be adjusted to an appropriate height by the fifth electric servo cylinder via the fifth guide rail, the sixth electric servo cylinder can drive the flexible grinding head to rotate to an appropriate angle, the seventh servo motor drives the flexible grinding head to rotate via the second synchronous belt, and when the rotating flexible grinding head contacts a valve hole of the wheel at the right side, burrs thereon can be removed; the upper rim burr removing system and the valve hole burr removing system can be switched by the third servo motor via the swivel to remove burrs at specific positions of the wheel at the left side.

* * * * *